US007201553B2

(12) United States Patent
Spatafora

(10) Patent No.: US 7,201,553 B2
(45) Date of Patent: Apr. 10, 2007

(54) METHOD AND DEVICE FOR FEEDING REELS TO A MACHINE

(75) Inventor: Mario Spatafora, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 297 days.

(21) Appl. No.: 10/477,214

(22) PCT Filed: May 13, 2002

(86) PCT No.: PCT/IT02/00313

§ 371 (c)(1),
(2), (4) Date: Apr. 26, 2004

(87) PCT Pub. No.: WO02/092483

PCT Pub. Date: Nov. 21, 2002

(65) Prior Publication Data

US 2006/0051185 A1 Mar. 9, 2006

(30) Foreign Application Priority Data

May 11, 2001 (IT) ..... BO2001A0289

(51) Int. Cl.
*B66C 1/00* (2006.01)

(52) U.S. Cl. ..... 414/729; 294/907; 242/559; 414/795.4; 414/800; 414/911

(58) Field of Classification Search ..... 414/729, 414/796.4, 796.5, 797, 908, 910, 911, 800; 242/559, 559.1, 559.4, 563; 294/907, 64.1; 356/139.1

See application file for complete search history.

(56) References Cited

U.S. PATENT DOCUMENTS

| | | | | |
|---|---|---|---|---|
| 3,730,368 | A * | 5/1973 | Dalglish | 414/621 |
| 3,758,144 | A * | 9/1973 | Dalglish | 294/64.1 |
| 5,487,638 | A * | 1/1996 | Salsburg et al. | 414/796.9 |
| 6,320,653 | B1 * | 11/2001 | Feist | 356/139.1 |

FOREIGN PATENT DOCUMENTS

| | | |
|---|---|---|
| EP | 0 551 854 A2 | 7/1993 |
| EP | 0 577 986 A2 | 1/1994 |
| EP | 0 994 057 A1 | 4/2000 |

* cited by examiner

*Primary Examiner*—Donald Underwood
(74) *Attorney, Agent, or Firm*—Birch, Stewart, Kolasch & Birch, LLP

(57) ABSTRACT

A device (2) for feeding reels (3) has a manipulator (14) having a gripping member (19) for picking up one reel (3) at a time off a pallet (16) and transferring the reel (3) to an unwinding pin (4*a*; 4*b*) on a machine (1); the gripping member (19) is enabled to pick up a reel (3) off the pallet (16) when at least one reference point (k1) of the gripping member (19) lies inside a central hole (7) of the reel (3).

21 Claims, 3 Drawing Sheets

METHOD AND DEVICE FOR FEEDING REELS TO A MACHINE

This application is the national phase under 35 U.S.C. § 371 of PCT International Application No. PCT/IT02/00313 which has an International filing date of May 13, 2002, which designated the United States of America.

TECHNICAL FIELD

The present invention relates to a method of feeding reels to a machine.

More specifically, the present invention relates to a method of feeding reels to a machine defined by a cigarette packaging machine, to which the following description refers purely by way of example.

BACKGROUND ART

Cigarette packaging machines now operate at such high output rates as to require large amounts of packaging material, which is partly supplied in the form of strips wound into reels. Each reel comprises a strip of packaging material wound about a spool having a central hole, and is fitted onto an unwinding pin on the packaging machine. The strip of packaging material is unwound off the reel, and sheets of packaging material are cut off the strip and folded about groups of cigarettes.

The increase in the amount of packaging material required calls for automatic reel handling to speed up reel feed to the machine, which in turn calls for determining the position of the reel to enable a reel manipulator to grip the reel by means of a gripping member and align the reel with an unwinding pin on the packaging machine.

Patent EP-A-551,854 relates to a manipulator featuring a reel gripping member and for picking reels off a pallet on which the reels are arranged with their respective axes positioned vertically. The gripping member has a TV camera for picking up an image of a reel; and an arithmetic unit for processing the image data by means of an algorithm based on translation and inversion of the image to determine the coordinates of a characteristic point on the reel. Once the coordinates of the characteristic point on the reel are determined, the manipulator sets the gripping member to a given position to grip the reel correctly.

Though reliable and capable of transferring a large number of reels per unit of time, the arithmetic unit of the above manipulator for processing the points in the image is relatively expensive.

DISCLOSURE OF THE INVENTION

It is an object of the present invention to provide a straightforward, low-cost method of feeding reels to a machine.

According to the present invention, there is provided a method of feeding reels to a machine from a store of reels close to said machine; each reel having an axis, a central hole which is engaged by an unwinding pin on said machine, and two flat faces perpendicular to said axis; and the method being characterized by determining whether at least one reference point of a gripping member of a manipulator lies inside the hole of a reel in the store; picking up said reel by means of the gripping member when the reference point lies inside the hole of said reel; and transferring said reel from said gripping member to said unwinding pin.

The present invention also relates to a device for feeding reels to a machine.

According to the present invention, there is provided a device for feeding reels to a machine from a store of reels close to said machine; each reel having an axis, a central hole which is engaged by an unwinding pin on said machine, and two flat faces perpendicular to the axis; and the device being characterized by comprising a manipulator having a gripping member for picking up a reel from said store when at least one reference point of the gripping member lies inside the hole of said reel.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
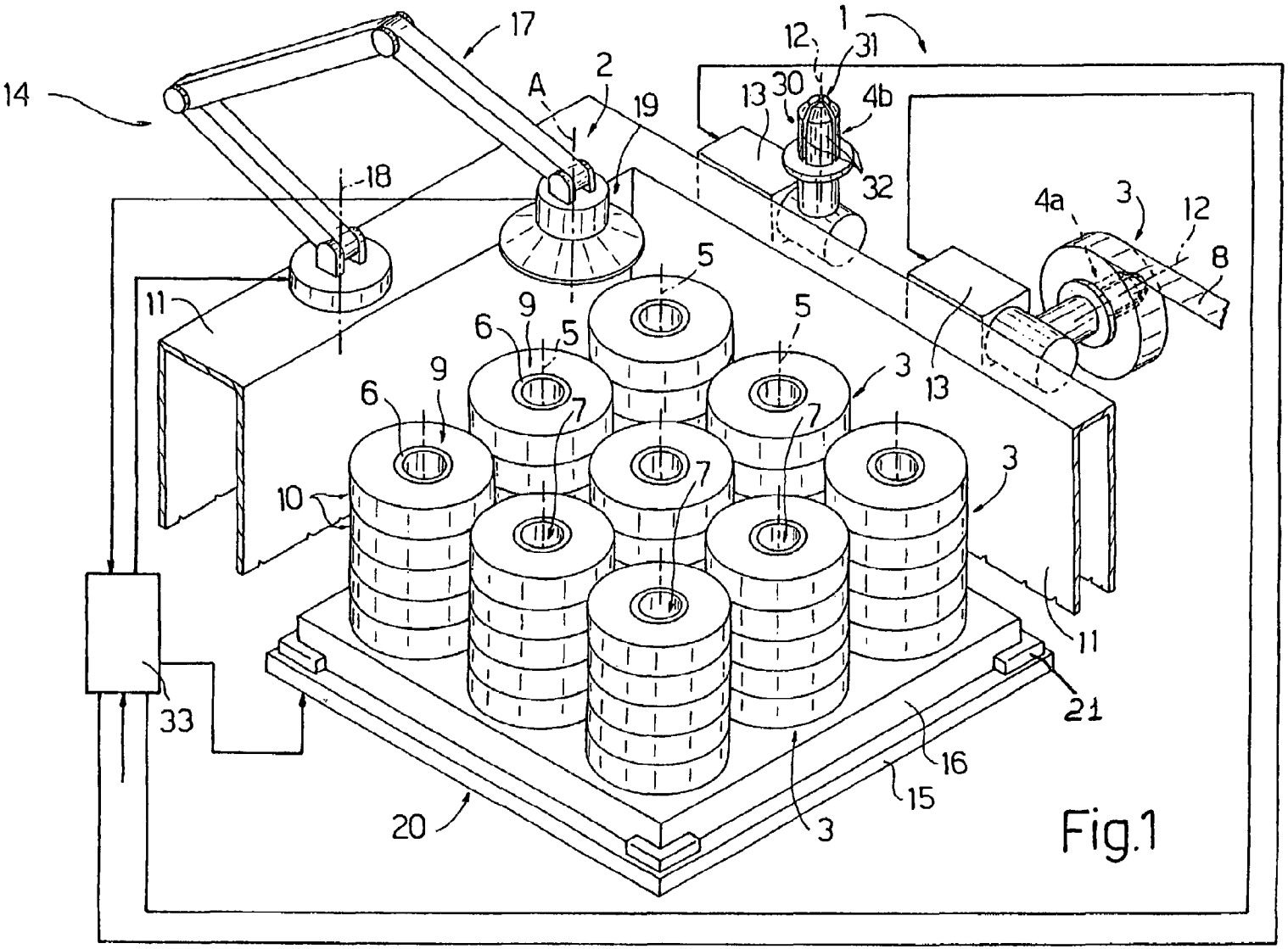
FIG. 1 shows a view in perspective, with parts removed for clarity, of a packaging machine featuring a reel feed device in accordance with the present invention.

Number 1 in FIG. 1 indicates as a whole a cigarette packaging machine for producing packets of cigarettes not shown.

Machine 1 comprises a feed device 2 for supplying reels 3; and two unwinding pins 4*a* and 4*b* for unwinding reels 3. Pin 4*a* is shown in a position supporting a reel 3 being unwound; and pin 4*b* in a position to receive a reel 3 from feed device 2.

Each reel 3 has an axis 5, and comprises a spool 6 having a hole 7; and a strip 8 of packaging material wound about spool 6 to form two parallel, substantially flat lateral faces 9 perpendicular to axis 5, and a substantially cylindrical face 10 parallel to axis 5.

Machine 1 comprises a frame 11 supporting unwinding pins 4*a* and 4*b*, each of which has an axis 12 and a drive member 13 for switching pin 4*a*, 4*b* between the unwinding position in which axis 12 is horizontal, and the receiving position in which axis 12 is vertical.

Device 2 for feeding reels 3 comprises a manipulator 14 for manipulating reels 3, and a platform 15 for supporting a pallet 16 on which reels 3 are arranged in orderly manner with respective axes 5 positioned vertically. Manipulator 14 comprises an articulated arm 17 fixed at one end to frame 11 to rotate about a vertical axis 18, and supporting at the opposite end a gripping member 19 for gripping one reel 3 at a time. Platform 15 is set to a given position with respect to machine 1, and comprises a lifting device 20, and locating elements 21 for locating pallet 16 with respect to platform 15.

Figure 2:
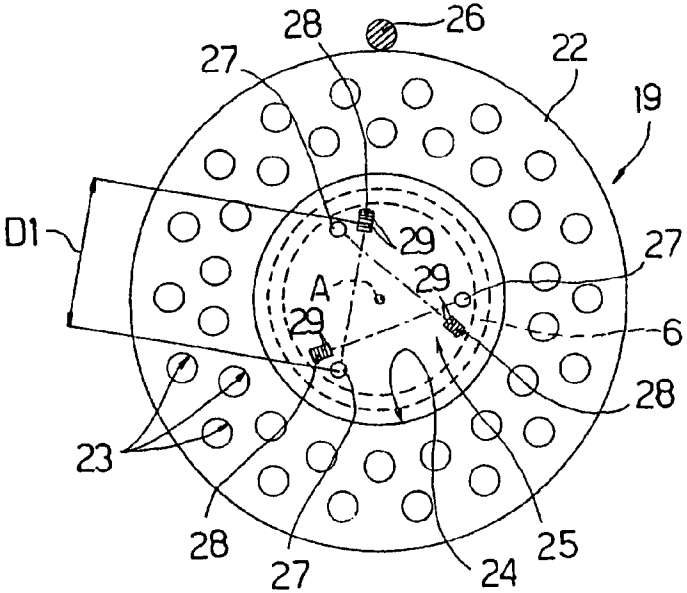
FIG. 2 shows a larger-scale underside view of a gripping member of the FIG. 1 device.

Gripping member 19 is bell-shaped with an axis A, and, as shown more clearly in FIG. 2, comprises an annular plate 22 in which are formed suction holes 23 selectively connectable to a vacuum source not shown, and a cavity 24 housing three distance sensors 25. Gripping member 19 has a contact sensor 26 located along annular plate 22 and for arresting manipulator 14 when gripping member 19 contacts a reel 3.

Figure 3:
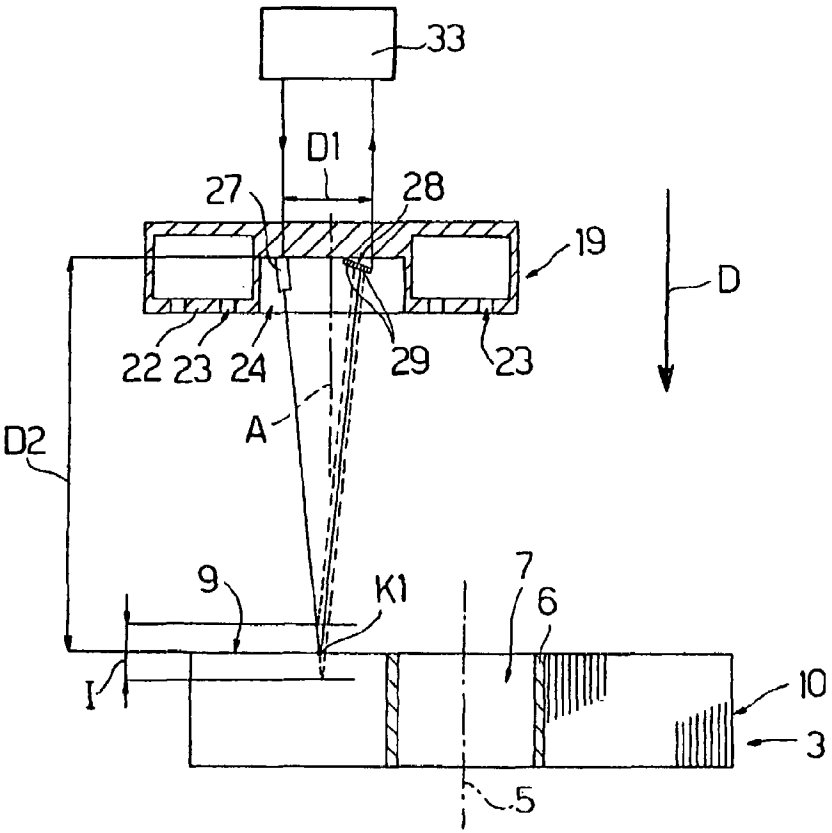

With reference to FIG. 3, each sensor 25 comprises an emitter 27 for emitting a beam of electromagnetic waves; and a receiver 28 for receiving a beam of electromagnetic waves. Emitter 27 is located at a distance D1 from receiver 28 and emits a beam so oriented that a surface (face 9 of reel 3) facing, parallel to and located a given distance D2 from annular plate 22 reflects the beam in a position in which receiver 28 is able to pick up the reflected beam. Distance D2 is measured parallel to axis A and axis 5, and distance D1 is measured perpendicular to axis A. Receiver 28 is defined by a number of adjacent cells 29 sensitive to electromagnetic waves, so that receiver 28 is able to receive the reflected beam when the reflecting surface lies within a given range I (parallel to axes 5 and A) about distance D2. With reference to FIG. 2, gripping member 19 is equipped with three sensors 25, the emitters 27 and receivers 28 of which are equally spaced about axis A of cavity 24 of gripping member 19.

With reference to FIG. 1, each pin 4*a*, 4*b* comprises an expansion spindle 30 having a tapered free end 31, and three sectors 32 movable between a closed position contacting one another, and an open position in which they are forced against spool 6 of a reel 3 to hold reel 3 in a given position about axis 12. As sectors 32 are opened, axis 5 of reel 3 is positioned to coincide with axis 12 of the unwinding pin. In other words, spindle 30 is self-centering.

Feed device 2 is controlled by a control unit 33, which processes the signals from sensors 25 and 26 and controls the movements of manipulator 14, lifting device 20 and pins 4*a* and 4*b*.

In actual use, and with reference to FIG. 1, a pallet 16 of reels 3 is placed on platform 15. Pallets 16 and reels 3 are of standard size, so that the arrangement of reels 3 on pallet 16 varies within relatively small limits. Consequently, reels 3 on pallet 16 on platform 15 are arranged with a certain tolerance about respective given positions memorized in control unit 33; and, to pick up a reel 3 for supply to machine 1, manipulator 14 positions gripping member 19 over one of reels 3 whose position and height in a vertical direction D are roughly known. Manipulator 14 positions gripping member 19 at or roughly at distance D2 from the top lateral face 9 of reel 3, as shown in FIGS. 3 and 4.

Figure 4:
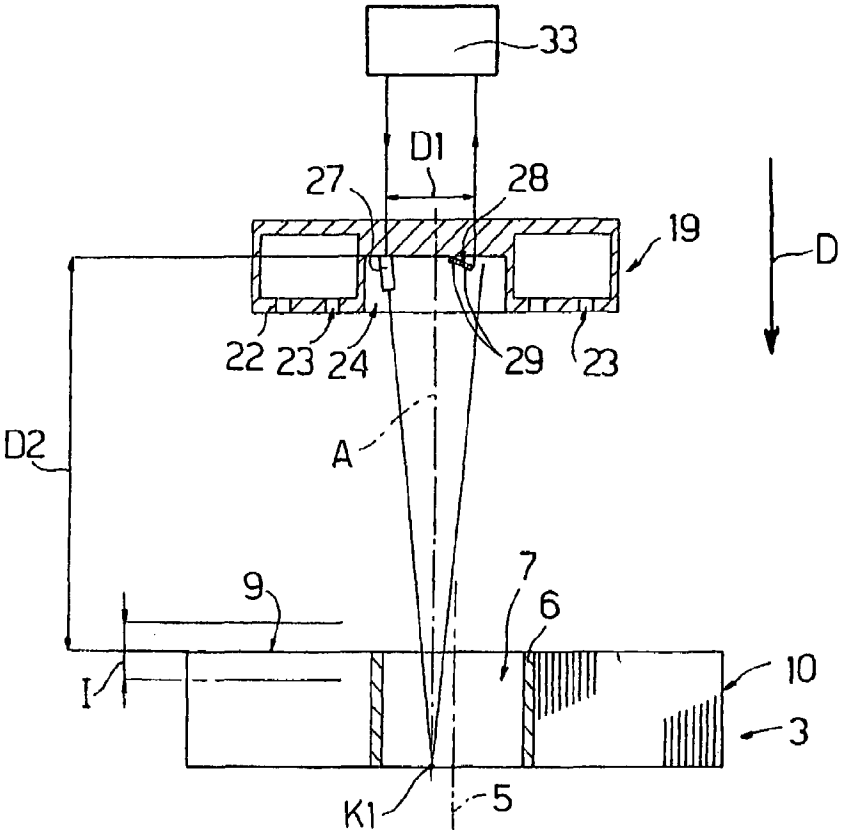
FIGS. 3 and 4 show schematic side views of a variation of the gripping member in two operating positions with respect to a reel.

Given the approximate positions of reels 3, gripping member 19 can be set to the FIG. 3 or 4 position, i.e. with axis A of gripping member 19 close to or at hole 7 in reel 3. For the sake of simplicity and to generalize the concept underlying the present invention, gripping member 19 in FIGS. 3 and 4 is equipped with one distance sensor 25. When gripping member 19 is positioned over reel 3, annular plate 22 is maintained horizontal so as to be parallel to lateral face 9 of reel 3. With reference to the FIG. 3 case, emitter 27 emits a beam of electromagnetic waves, which is reflected by lateral face 9 at a given point K1. Face 9 lying within range I of distance D2 enabling receiver 28 to receive the reflected beam, the reflected beam strikes one of cells 29 of receiver 28, which transmits a signal to control unit 33, which in turn determines the location of reflection point K1 on lateral face 9 of reel 3. When reflection point K1 is located on face 9, gripping member 19 and reel 3 are not sufficiently aligned to ensure reel 3 is positioned correctly on unwinding in 4*a*, 4*b*, so gripping member 19 is moved about its initial position in directions perpendicular to direction D. At each movement, sensor 25 determines whether reflection point K1 lies on lateral face 9 or in hole 7. When the beam enters hole 7, reflection point K1 may be located on a support underneath reel 3 or along an inner face of spool 6. Whichever the case, when the beam enters hole 7, the reflected beam does not strike receiver 28, on account of the reflecting surface not being within range I of distance D2, so that the absence of a receiving signal by receiver 28 combined with an emission signal by emitter 27 indicates gripping member 19 is correctly aligned with reel 3, or at least is aligned sufficiently to ensure correct transfer of reel 3 from gripping member 19 to unwinding pin 4*a*, 4*b*.

Manipulator 14 lowers gripping member 19 towards reel 3 in direction D until sensor 26 detects plate 22 contacting lateral face 9; suction holes 23 are then connected to the vacuum source, and reel 3 is raised for transfer to pin 4*b*; gripping member 19 and reel 3 are positioned over pin 4*b* so that axis A of member 19 is aligned with axis 12 of pin 4*b*; gripping member 19 is lowered onto pin 4*b* in direction D so that pin 4*b* engages hole 7, even if axis 5 of reel 3 is not perfectly aligned with pin 4*b*, by virtue of the tapered free end 31 of spindle 30; reel 3 is released by gripping member 19; and spindle 30 is expanded so that axis 5 of reel 3 coincides with axis 12 of unwinding pin 4*b*.

In other words, before a reel 3 is picked up, a check is made to determine whether reference point K1 of gripping member 19 lies inside hole 7 of reel 3. Obviously, the more reference points there are, the more accurately and faster hole 7 of reel 3 is determined.

Figure 7:
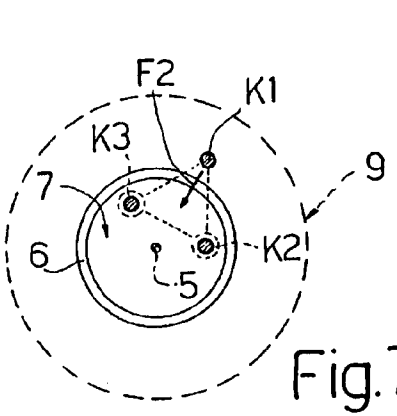
FIGS. 5, 6 and 7 are schematic plan views showing the position of a gripping member of the FIG. 1 device with respect to a reel.
Figure 6:
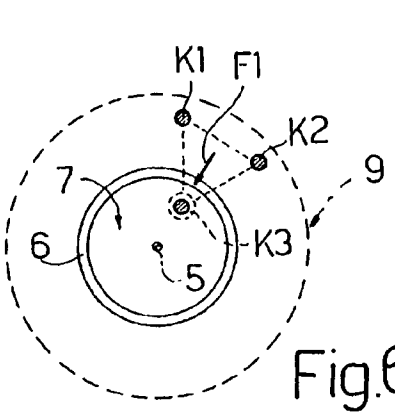
Figure 5:
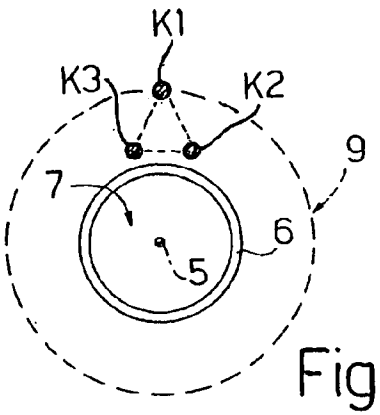

FIGS. 5, 6 and 7 show, schematically, the case in which gripping member 19 comprises three distance sensors 25, as in FIG. 2. In FIG. 5, three separate reflection points K1, K2, K3 are located on lateral face 9 of reel 3, which is tantamount to the FIG. 3 situation, so that a number of movements about the initial position are required to determine the location of hole 7. This may result in the situation shown in FIG. 6, in which two points K1 and K2 are located on lateral face 9, and point K3 lies in hole 7 and is therefore not picked up by receiver 28. Control unit 33, however, knows the hypothetical position of point K3 and commands a movement in the direction of arrow F1, i.e. towards point K3, to also bring points K1 and K2 inside hole 7.

Alternatively, as shown in FIG. 7, one point K1 may be located on lateral face 9 of reel 3, and points K2 and K3 inside hole 7. In which case, manipulator 14 moves gripping member 19 in a direction perpendicular to the line joining hypothetical points K2 and K3 and in the direction of arrow F2 until point K1 also lies inside hole 7.

In one variation, control unit 33 does not know the height of reels 3 in direction D, but only the approximate arrangement of reels 3 in the plane perpendicular to direction D, so that, when positioned over a reel 3, gripping member 19 is lowered into contact with reel 3; and, upon sensor 26 indicating contact between gripping member 19 and reel 3, gripping member 19 is set to or within the range about distance D2 so as to effectively determine the position of gripping member 19 with respect to reel 3, as in the previous case.

The method and device according to the present invention are particularly advantageous by only requiring the processing of a relatively small number of data items.

When the position of gripping member 19 with respect to reel 3 is determined using only one reference point K1, reel 3 is centered on unwinding pin 4*a* or 4*b* by expansion spindle 30. When the position of gripping member 19 with respect to reel 3 is determined using three reference points K1, K2, K3, axis A of gripping member 19 can be aligned with axis 5 of reel 3 by simply selecting three reference points K1, K2, K3 located, at distance D2 from a reflecting surface, along a hypothetical circumference slightly smaller in diameter than hole 7, so that reel 3 is transferred to pin 4*a* or 4*b* with no need for centering by a self-centering spindle 30. In a further variation not shown, the same result as with three reference points can also be achieved with only two separated, at distance D2 from a reflecting surface, by a distance slightly less than the diameter of the reel hole.

The invention claimed is:

1. A method of feeding reels to a machine from a store of reels close to said machine; each reel having an axis , a central hole which is engagable by an unwinding pin on said machine, and two flat faces perpendicular to said axis ; and the method comprising the steps of:

positioning said gripping member facing one of said flat faces of a reel;

bringing said gripping member into contact with said flat face;

withdrawing said gripping member perpendicularly to said flat face to position the gripping member at a second distance from the flat face or within a range (I) about said second distance;

determining whether at least one reference point of a gripping member of a manipulator lies inside the hole of a reel in the store;

picking up said reel by the gripping member when the reference point lies inside the hole of said reel; and transferring said reel from said gripping member to said unwinding pin.

2. The method as claimed in claim 1, further comprising emitting a beam of electromagnetic waves onto a reel by an emitter on said gripping member; said reference point being the reflection point of said emitted beam.

3. The method as claimed in claim 2, wherein said gripping member comprises a receiver located at a first distance from said emitter so as to pick up the reflected beam when said flat face is located at said second distance, parallel to said axis, from said gripping member, and the reflection point lies on said flat face.

4. The method as claimed in claim 3, wherein said receiver comprises a number of adjacent cells sensitive to electromagnetic waves, so as to pick up the reflected beam when the flat face lies within the given range (I), parallel to said axis, about said second distance from the gripping member, and the reflection point lies on said flat face.

5. The method as claimed in claim 3, further comprising moving said gripping member parallel to said flat face when said receiver picks up the reflected beam.

6. The method as claimed in claim 5, further comprising picking up said reel when said receiver does not pick up the reflected beam.

7. The method as claimed in claim 3, wherein said gripping member comprises three distance sensors; each distance sensor comprising one of said emitters and one of said receivers; each distance sensor generating a responsive reference point; and said gripping member picking up a reel when none of the receivers pick up the respective reflected beams.

8. The method as claimed in claim 1, further comprising determining said contact between the gripping member and the flat face by a sensor.

9. A device for feeding reels to a machine from a store of reels close to said machine; each reel having an axis, a central hole which is engagable by an unwinding pin on said machine, the device comprising:

a manipulator having a gripping member for picking up a reel from said store when at least one reference point of the gripping member lies inside the hole of said reel;

a control unit, which commands a movement of the manipulator to move said gripping member for positioning said gripping member facing one of said flat faces of a reel; bringing said gripping member into contact with said flat face; and withdrawing said gripping member perpendicularly to said flat face to position the gripping member at a second distance from the flat face or within a range (I) about said second distance.

10. The device as claimed in claim 9, further comprising an emitter located on said gripping member to emit a beam of electromagnetic waves directed onto the reel; said reference point being a reflection point of the said emitted beam.

11. The device as claimed in claim 10, further comprising a receiver for picking up a reflected beam when the reflection point lies on said flat face, and not for picking up the reflected beam when the reflection point lies inside the hole.

12. The device as claimed in claim 11, wherein the receiver is located at a first distance from said emitter so as to pick up the reflected beam when said flat face is located at said second distance, parallel to said axis, from gripping member, and the reflection point lies on said flat face.

13. The device as claimed in claim 12, characterized in that wherein said receiver comprises a number of adjacent cells sensitive to electromagnetic waves, so as to pick up reflected beam when the flat face lies within a the given range (I), parallel to said axis, about said second distance from the gripping member, and the reflection point lies on said flat face.

14. The device as claimed in claim 11, wherein the control unit commands a movement of the manipulator to move said gripping member parallel to said flat face when the reflection point lies on said flat face.

15. The device as claimed in claim 14, wherein said gripping member comprises an annular plate having suction holes to pick up said reel when said reflection point lies inside the hole of said reel and the plate is positioned contacting said flat face.

16. The A-device as claimed in claim 12, wherein said gripping member comprises three distance sensors; each distance sensor comprising a said emitter and a said receiver; the distance sensors generating distinct respective reference points; and said gripping member picking up a reel when the reference points all lie inside the hole of the reel.

17. The device as claimed in claim 9, further comprising a platform for supporting said store of reels in a given position with respect to said machine and to said manipulator.

18. The device as claimed in claim 10, wherein said store is a pallet of reels.

19. The device as claimed in claim 17, wherein said platform comprises a lifting device.

20. The device as claimed in claim 9, wherein said unwinding pin comprises a self-centering spindle.

21. The device as claimed in claim 20, wherein said self-centering spindle comprises a tapered free end.

* * * * *